US006386907B1

(12) United States Patent
Ruffa

(10) Patent No.: US 6,386,907 B1
(45) Date of Patent: May 14, 2002

(54) BATTERY CLAMP

(75) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/413,093

(22) Filed: Oct. 5, 1999

(51) Int. Cl.[7] ..... H01R 11/00
(52) U.S. Cl. ..... 439/504; 439/506
(58) Field of Search ..... 439/504, 181, 439/186, 187, 506, 759, 822, 283, 281, 279, 183, 184; 200/19.2, 19.27, 19.01, 19.4, 275; 320/105

(56) References Cited

U.S. PATENT DOCUMENTS 5,129,843 A * 7/1992 Bowsky et al. ..... 439/685
5,131,858 A * 7/1992 Heimbrock ..... 439/181
5,601,452 A * 2/1997 Ruffa ..... 439/504

* cited by examiner

*Primary Examiner*—Gary F. Paumen
*Assistant Examiner*—Ross Gushi
(74) *Attorney, Agent, or Firm*—Michael J. McGowan; Prithvi C. Lall; Michael F. Oglo

(57) ABSTRACT

An improved automotive battery jumper cable includes an electrically conductive cable which is terminated at each end by a terminal clamp. Each of the terminal clamps includes a pair of gripping members each having a jaw end and a handle end. The gripping members are pivotably connected to each other about an axis between the jaw ends and the handle ends. A torsion spring is mounted on the gripping members for normally urging the jaw ends toward each other. Each of the jaw ends of the gripping members is provided with a copper jaw member for engaging and grasping the battery terminal. One of the jaws on each clamp is not electrically connected to the cable. One of the battery clamp is electrically connected to the respective end of the cable via an encapsulated pressure switch. The pressure switch is physically positioned between the copper jaw and the jaw end of the gripping member such that spring pressure provided by the torsion spring is operative for closing the encapsulated pressure switch when the clamp is mounted on a battery terminal. This provides a gas free region around conductive plates of the encapsulated switch to prevent arching. An in-line fuse can be mounted in the cable to prevent short circuits of the batteries.

3 Claims, 6 Drawing Sheets

BATTERY CLAMP

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The instant invention relates to an improved battery clamp for a set of automotive battery jumper cables for connecting a weak battery to a stronger battery, and more particularly to an improved clamp for a jumper cable set which reduces the chance of an electrical arc when making the connection. Subject invention is a further improved version of the automotive battery jumper cable set described and claimed in my U.S. Pat. No. 5,601,452 issued on Feb. 11, 1997. That patent is incorporated herein by reference in subject patent application and will be referred to in subject patent application.

(2) Description of the Prior Art

It is well known that automotive batteries produce both hydrogen and oxygen gas as a result of being charged and discharged. These gases can potentially be ignited, causing an explosion. One potential cause of ignition can be sparks due to electrical arcs that can occur when connecting jumper cables to the battery terminals. Essentially, jumper cables comprise two electrically conductive cables with spring clamps at each end of the cables to releasably engage the battery terminals. Typically, an arc, or sparking occurs directly at the battery terminal when connecting the last, i.e., fourth, clamp to the respective battery. To reduce the chance of such sparks igniting the gases around the battery, jumper cables having remote switching devices locating well away from the battery terminals have heretofore been known in the art. In this regard, the U.S. Pat. No. 4,662,696 to Asbury, is representative of the prior art devices. The patent to Asbury discloses a battery jumper cable having a safety switch located intermediate the clamp ends of the cable. The switch is normally biased to the open position and includes a handle, which when depressed makes electrical contact between the leads of the battery cable. However, there is a need for an automotive battery jumper cable set which includes a self-contained switch as opposed to a remote switch.

SUMMARY OF THE INVENTION

The instant invention provides an automotive battery jumper cable set including an improved clamp which eliminates the need for a manually activated remote safety switch. The instant jumper cable set assembly comprises an electrically conductive wire which is terminated at one thereof by the improved clamp. As described in the above-mentioned patent, the improved clamp comprises a pair of gripping members each having a jaw end 14A and a handle end 14B and the gripping members are pivotably connected to each other about an axis 18 between the jaw ends and the handle ends. As fully described in my above-mentioned earlier patent, a torsion spring 20 is mounted on the gripping members for normally urging the jaw ends thereof each other, each of the jaw ends of the gripping members is provided with a copper jaw member for engaging and grasping the battery terminal and one of the jaws on each clamp is not connected to the cable. However, the other jaw of the improved clamp is electrically connected to the respective end of the cable via an encapsulated pressure switch. As mentioned in my above-identified patent, it is to be noted that only one of the four clamps needs to have the encapsulated pressure switch to prevent arcing. However, one can have an encapsulated pressure switch in all four clamps as well. The pressure switch is physically positioned between the copper jaw and the jaw end of the gripping member such that spring pressure provided by the torsion spring is operative for closing the pressure switch when the clamp is mounted on a battery terminal. One contact of the pressure switch is connected to the copper jaw and the other contact is connected to the cable. Both contacts are electrically localized within the encapsulated switch. Since electrical connection is completed inside the encapsulated switch, any potential spark is insulated within the switch. An in-line fuse or a circuit breaker may also be positioned in the cable to provide short-circuit protection. The improved switch according to the teachings of subject invention provides an enclosed space at the time of the closing of the pressure switch which is free of any gas and this avoids any explosion for any electric sparks or arcing.

Accordingly, among the objects of the instant invention are: the provision of an improved clamp for an automotive battery jumper cable set which eliminates arcing in the vicinity of the battery terminal; the provision of a battery jumper cable assembly which is terminated at least one end by the improved clamp of subject invention; and the provision of a battery jumper cable assembly including the instant clamp members and further including an in-line fuse or circuit breaker in the cable for preventing short circuits.

Other objects, features and advantages of the invention shall become apparent as the description thereof proceeds when considered in connection with the accompanying illustrative drawings.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

DESCRIPTION OF THE PREFERRED EMBODIMENT

Figure 1:
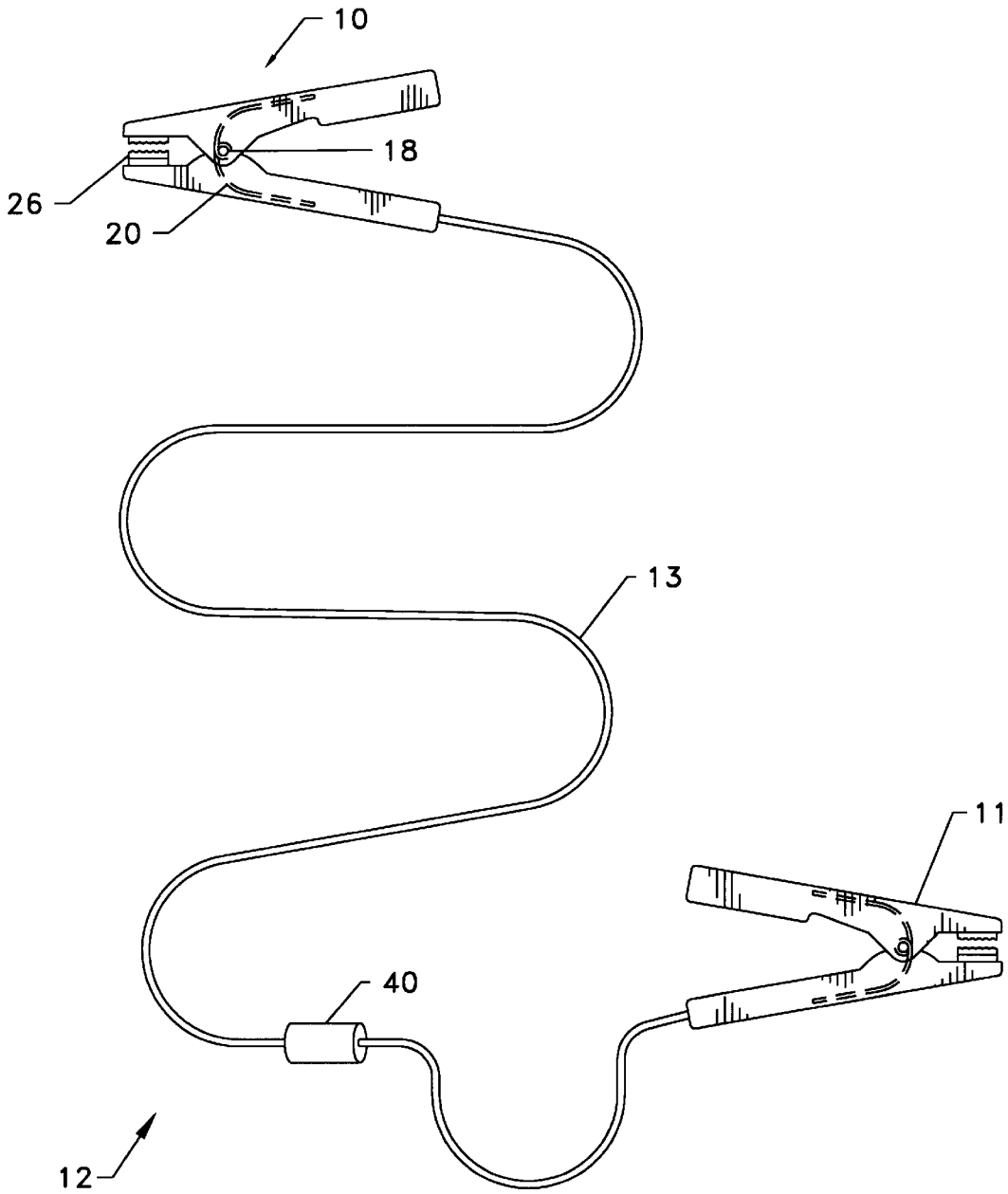
FIG. 1 is a perspective view of the improved non-arcing terminal clamp of the instant invention as a part of battery jumper cable system.
Figure 1A:
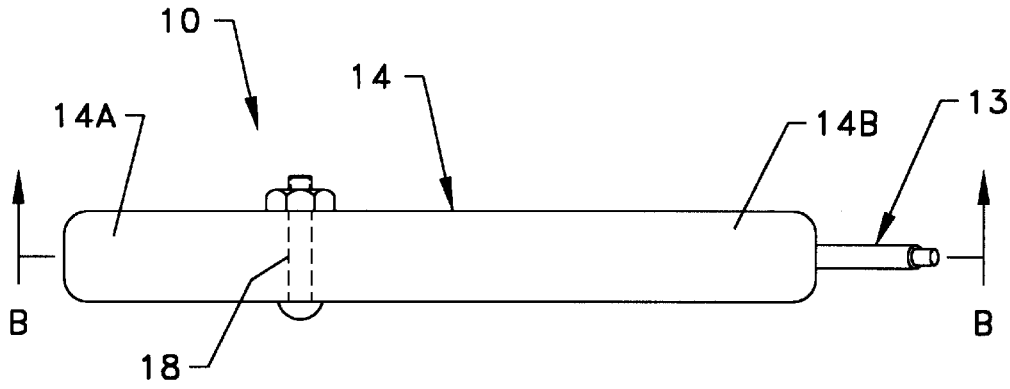
FIG. 1A is a top view of the improved battery clamp.
Figure 1B:
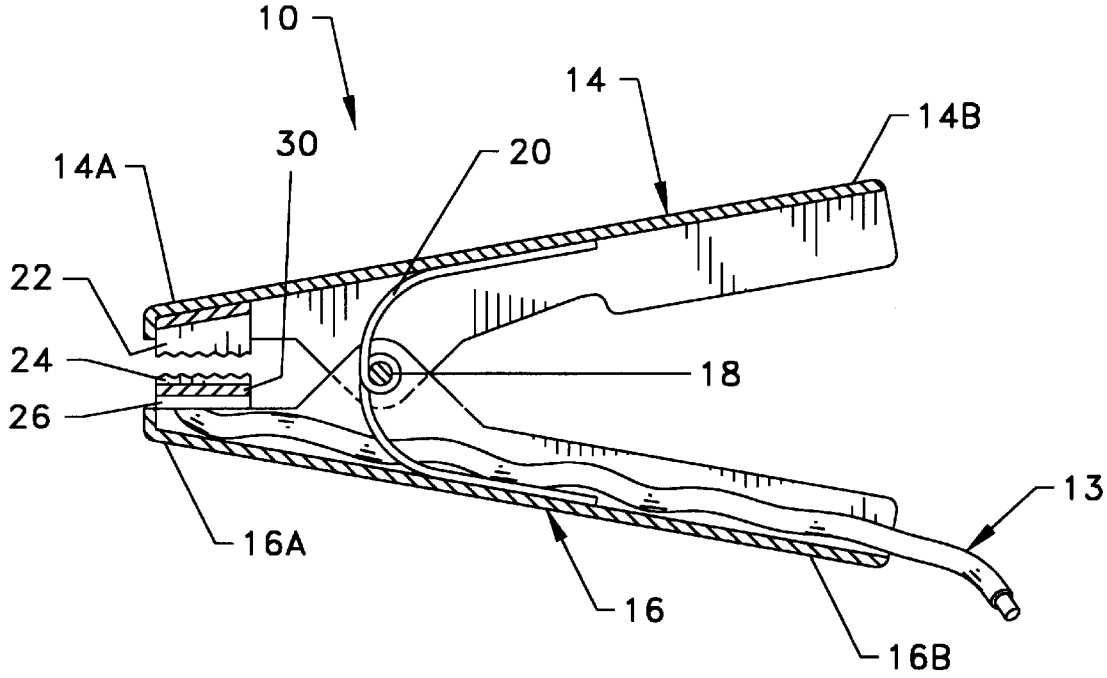
FIG. 1B is the improved battery clamp cross section along line B—B of FIG. 1A.
Figure 2:
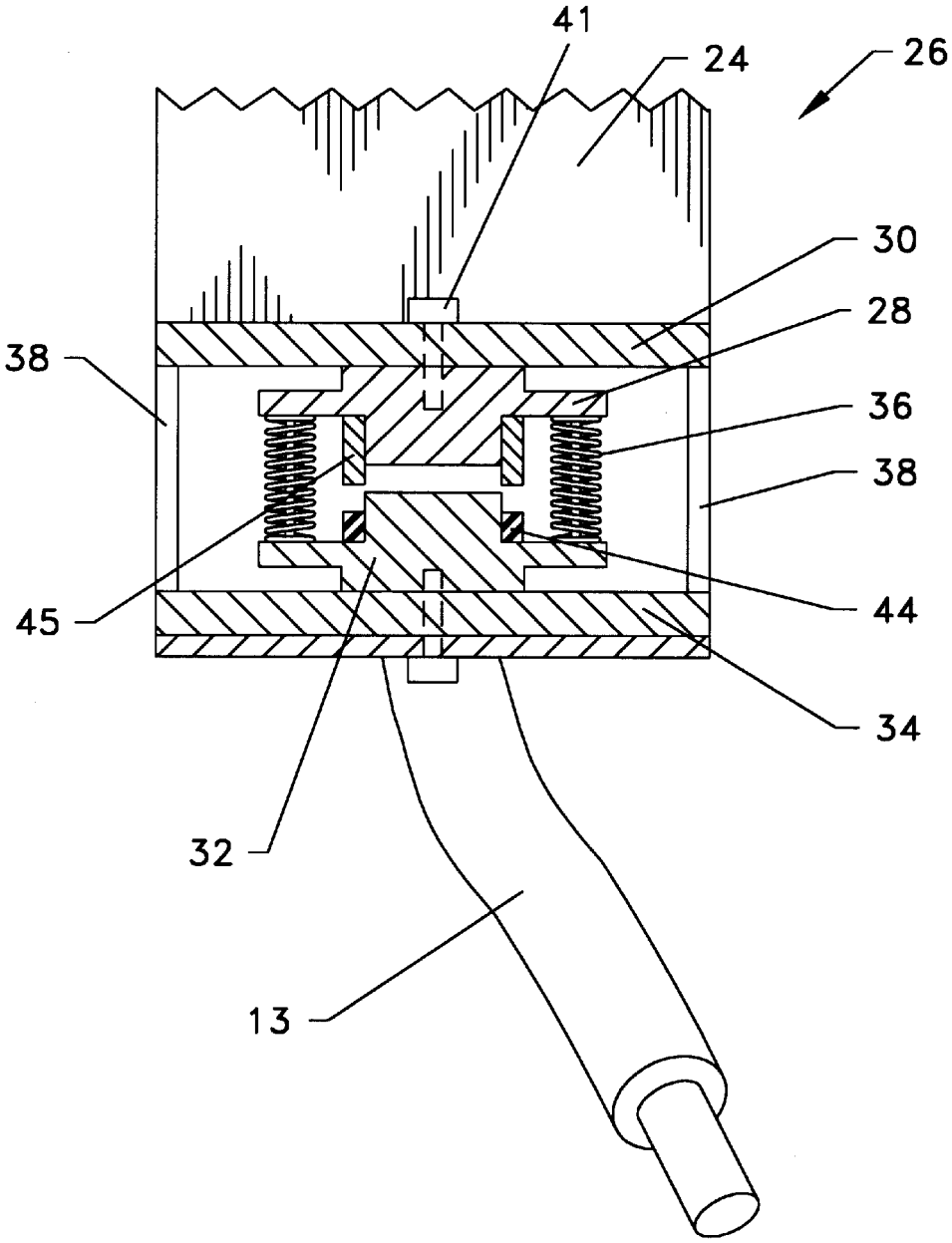
FIG. 2 is a perspective and cross sectional view of a battery jumper cable set.
Figure 3:
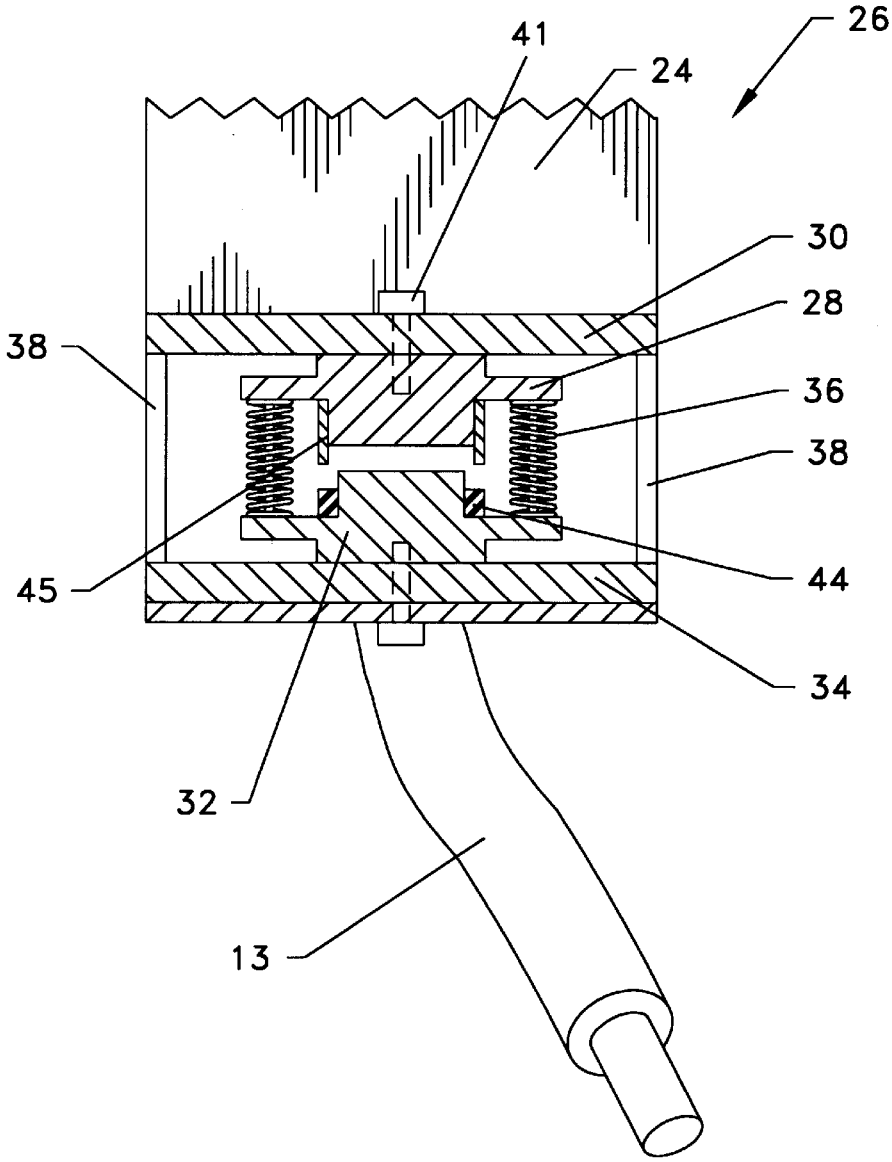
FIG. 3 is an enlarged cross-sectional view of the pressure switch in its open position i.e., before application of pressure to close the pressure switch as a part of battery jumper cable system.

Referring now to the drawings, the improved non-arcing clamp of the instant invention is illustrated and generally indicated at 10 in FIGS. 1–5. As described here and in my above-identified patent, the improved clamp 10 is utilized in a jumper cable assembly 12 of (FIG. 1) wherein it is operative for reducing arcing, or sparking, when making a connection between two automotive batteries. The other remaining clamps are designated as 11 and do not include a pressure switch. The jumper cable assembly 12 comprises an insulated, electrically conductive cable or wire 13 which is terminated at each end by one of the clamps. As explained in my cited patent each of these clamps comprises a pair of gripping members 14 and 16, each of the gripping members having a respective jaw end 14A and 16A, and a respective handle ends 14B and 16B. The gripping members 14 and 16 are pivotably connected to each other by a pivot pin 18 which forms a pivot axis positioned between the jaw ends and the respective handle ends. As shown in the U.S. Pat. No. 5,601,452 as well as in FIG. 1B of subject patent application; a torsion spring 20 is received around the pivot pin 18 such that it is operative for normally urging the jaw ends 14A and 16A toward each other. Each of the jaw ends 14A and 16A of the respective gripping members such a 14 and 16 is provided with a respective copper jaw members 22 and 24, for engaging and grasping a battery terminal. One jaw member 22 is not electrically connected to the cable or wire 13. However, the jaw member 24 is electrically connected to the respective end of the cable 13 through an encapsulated pressure switch, generally indicated at 26. The pressure switch 26 includes a first contact 28 which is electrically connected to a land portion or inductive plate 30 of the jaw member 24, and further includes a second contact 32 which is electrically connected to a copper pad or plate 34 which in turn is electrically connected to the cable 13. The contacts 28 and 32 are biased to an open position, as shown in FIGS. 2 and 3, by non-conductive spring members 36. It is to be noted that conductive spring members can also be used, but they must be insulated from the contacts. They can either be coated with a polymer or they can be insulated at the points of contact with the seats of the contacts. The entire switch 26 is encapsulated by a resilient insulating material 38, such as neoprene, to isolate the contacts 28, 32 from the surrounding environment. The pressure switch 26 is physically located between the copper jaw 22 and the jaw end of the gripping member such that spring pressure provided by the afore-mentioned torsion spring (not shown) is operative for closing the pressure switch, i.e., moving contacts 28, 32 into electrical engagement, when the clamp 10 is mounted on a battery terminal.

Figure 4:
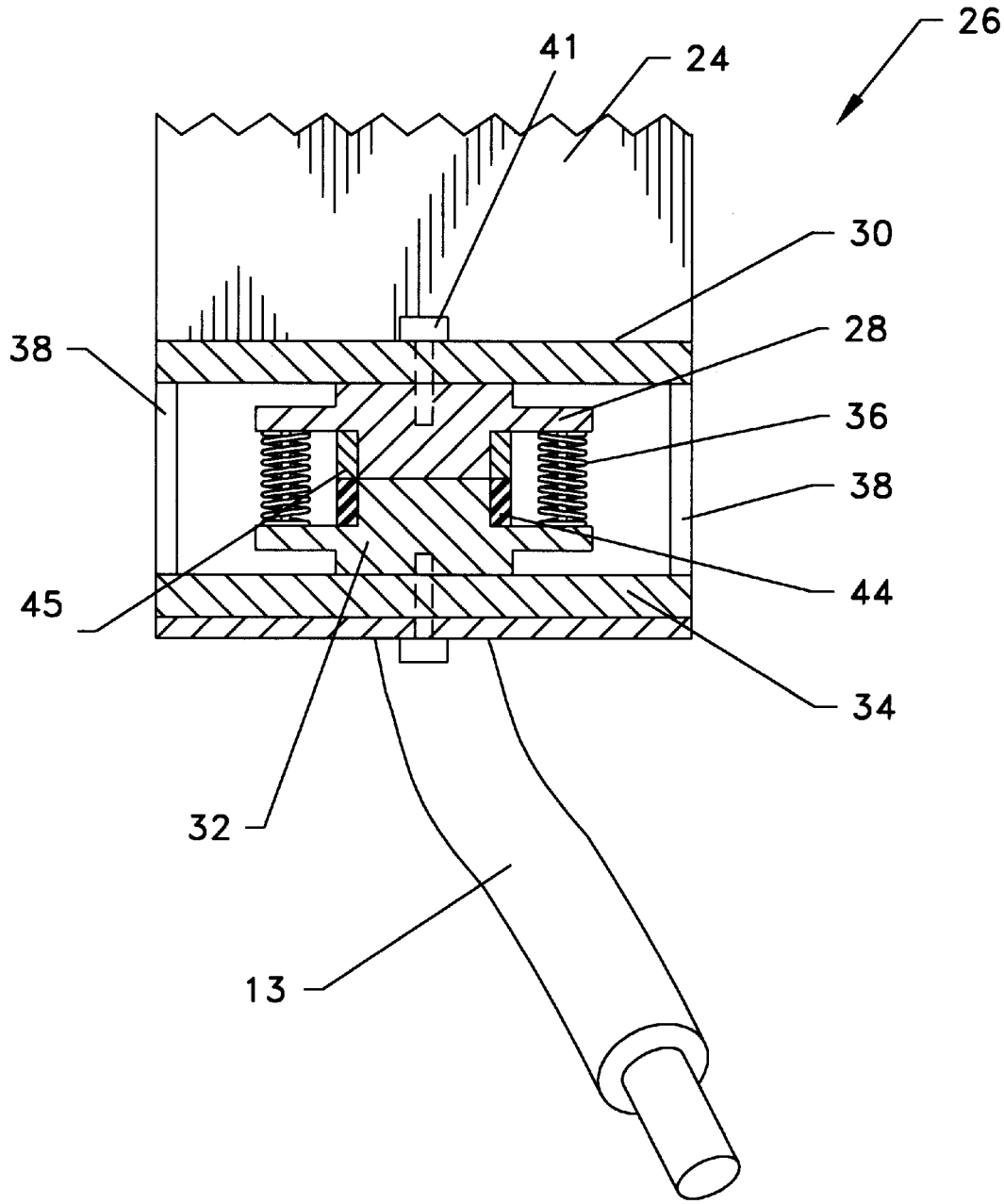
FIG. 4 is another embodiment of subject invention view of a cable assembly in accordance with the instant invention.
Figure 5:
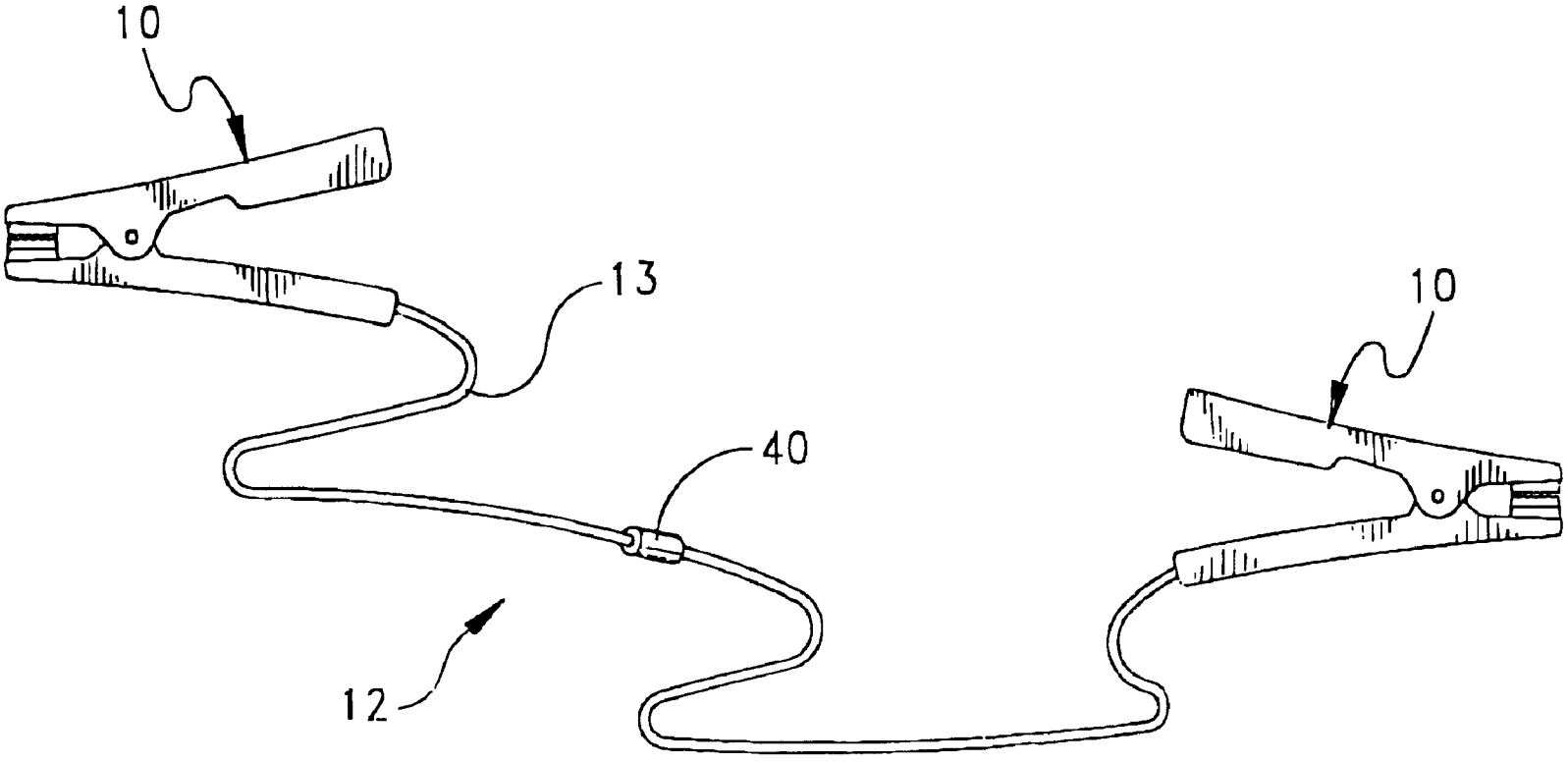
FIG. 5 is an enlarged cross-sectional view of one embodiment of the pressure switch in its closed position, i.e., after the jaw of the clamp is in contact with the battery post, so as to close the pressure switch.

FIG. 4 is one embodiment of subject invention wherein the the insulator generally cylindrical rings 44 and 45 are made of flexible material e.g., rubber so that they are sufficiently compressible under pressure when the improved clamp 10 is encompassing the battery terminal that plates 28 and 32 are in contact with each other and have a gas isolated region around them. This further reduces arching in the area. FIG. 5 is another embodiment of the improved clamp 10 wherein generally cylindrical solid ring 44 is made of a flexible insulating material and ring 45 is made of a incompressible insulating material and is a hollow cylinder having its inner diameter of such a size that ring acts as a cap over ring 44 when plates 28 and 32 are in contact and the region inside the pressure switch is completely closed to prevent any arching. It is should be noted that FIG. 2 shows the pressure switch 26 in its open position whereas FIG. 4 shows the pressure switch in its closed position. It should be noted further that cable 13 also includes a fuse or a circuit breaker 40 to ensure the elimination of arching in the circuit when the improved clamp is placed around the battery terminal.

It can thus be seen that the electrical connection between contacts 28, 32 is completed within the switch 26 when the improved clamp hold the battery terminal. Since the electrical pressure connection is completed inside the encapsulated switch, any potential spark is insulated within the switch, away from the ambient environment, and thus the chance of ignition of hydrogen gas in the environment is reduced or eliminated.

The cable assembly 12 as shown in FIG. 1 may further comprise an in-line resettable fuse or a circuit breaker 40, positioned in the cable 13 to prevent short circuit of the battery where the improved clamp is placed around the battery terminal to prevent a short circuit in the event of reversed polarity connections.

The instant invention thus provides an effective non-arcing clamp which significantly reduces, or prevents the chance of electrical arc when making an electrical connection between two batteries. The encapsulated pressure switch 26 and its mounting position on the jaw end of the gripping member allow automatic closure of the switch 26 when making the connection, while also isolating the connection point from the surrounding environment. For these reasons, the clamp of the instant invention is believed to represent a significant improvement in the art.

While there is shown and described herein certain specific structure embodying the invention, it will be manifested to those skilled in the art that various modifications and rearrangements of the parts may be made without departing from the spirit and scope of the underlying inventive concept. As an example, the configuration of the insulating rings around the conductive conductor of the encapsulating pressure switch can be changed without deviating from the features of subject invention is not limited to the particular forms herein shown and described except insofar as indicate by the scope of the appended claims.

What is claimed is:

1. An improved battery clamp for a jumper cable set comprising:

a pair of gripping members, each having a jaw end and a handle end, said pair gripping members being pivotably connected to each other about an axis between the jaw ends and the handle ends;

spring means mounted on said pair of gripping members for normally urging the jaw ends toward each other and the handle ends away from one another;

a first jaw member secured to the jaw end of one of said pair of gripping members;

a second jaw member secured to the jaw end of the other of said pair of gripping members;

a pressure switch positioned between said second jaw member and one of said pair of gripping members such that spring pressure provided by said spring means is operative for closing said pressure switch when said clamp is mounted on a battery terminal, said pressure switch being encapsulated using a flexible insulating material, said pressure switch having a first contact in electrical communication with said second jaw member, and further having a second contact in electrical communication with an electrically conductive cable wherein said encapsulated pressure switch comprises two conducting plates, a first conducting plate attached to one end of said electrically conductive cable, a first generally cylindrical insulating piece attached to said first conducting plate and a second generally cylindrical insulating piece attached to said second conducting plate in such a way that upon closing of said encapsulated pressure switch, said first and second conducting plates come in contact and said first and second insulating pieces mate so as to form gas isolated area around said first and second conducting plates to prevent arcing in said area thereof; and means for closing said pressure switch so as to provide a gas isolated area inside said pressure switch when said pressure switch is in a closed position.

2. The improved battery clamp of claim 1 wherein said generally cylindrical first and second insulating pieces are made of a flexible insulating material so that upon closing of said encapsulated pressure switch, said generally cylindrical first and second insulating pieces are compressed so much that said first and second conducting plates are in contact with each other.

3. The improved battery clamp of claim 1 wherein said generally cylindrical first insulating piece is made of an incompressible insulating material forming generally a hollow cylinder having a inner diameter and said second generally cylindrical insulating piece is made of a compressible material and of generally cylindrical shape and said generally cylindrical first and second insulating pieces mate forming a contacting surface between said first and second conducting plates and forming a gas free area there around to prevent arcing in said area.

* * * * *